US005123546A

United States Patent [19]

Crum

[11] Patent Number: 5,123,546

[45] Date of Patent: * Jun. 23, 1992

[54] MERCHANDISER ASSEMBLY

[75] Inventor: Peter Crum, Belgium, Wis.

[73] Assignee: Oscar Mayer Foods Corporation, Madison, Wis.

[ * ] Notice: The portion of the term of this patent subsequent to May 7, 2008 has been disclaimed.

[21] Appl. No.: 671,322

[22] Filed: Mar. 19, 1991

Related U.S. Application Data

[63] Continuation of Ser. No. 455,838, Dec. 15, 1989, Pat. No. 5,012,936, which is a continuation of Ser. No. 176,954, Apr. 4, 1988, Pat. No. 4,907,707.

[51] Int. Cl.[5] ..... A47F 7/00

[52] U.S. Cl. ..... 211/59.3; 206/556

[58] Field of Search ..... 211/59.3, 59.2, 51, 211/94; 248/231.4; 312/71, 341.1; 206/556

[56] References Cited

U.S. PATENT DOCUMENTS

| | | | |
|---|---|---|---|
| 1,760,346 | 5/1930 | Correa | 248/231.4 |
| 2,098,844 | 11/1937 | Waxgiser . | |
| 2,110,299 | 3/1938 | Hinkle . | |
| 2,129,122 | 9/1938 | Follett . | |
| 2,139,520 | 12/1938 | Scheinman | 312/341.1 X |
| 2,668,648 | 2/1954 | Carlsen . | |
| 2,769,551 | 11/1956 | Just . | |
| 3,008,583 | 11/1961 | Lindell . | |
| 3,083,067 | 3/1963 | Vos et al. . | |
| 3,110,402 | 11/1963 | Mogulescu . | |
| 3,161,295 | 12/1964 | Chesley | 211/59.3 |
| 3,308,961 | 3/1967 | Chesley . | |
| 3,348,732 | 10/1967 | Schwarz . | |
| 3,452,899 | 7/1969 | Libberton . | |
| 3,703,964 | 11/1972 | Field | 211/184 |
| 3,767,084 | 10/1973 | Bayha . | |
| 3,780,873 | 12/1973 | Silva . | |
| 4,042,096 | 8/1977 | Smith . | |
| 4,454,948 | 1/1984 | Spamer | 211/59.2 |
| 4,706,821 | 11/1987 | Kohls et al. . | |
| 4,724,968 | 2/1988 | Wombacher . | |
| 4,730,741 | 3/1988 | Jackle | 211/59.3 |
| 4,762,236 | 8/1988 | Jackle, III et al. . | |

*Primary Examiner*—Alvin C. Chin-Shue

*Attorney, Agent, or Firm*—Lockwood, Alex, FitzGibbon & Cummings

[57] ABSTRACT

A merchandiser assembly is provided for storing and displaying products in a shelf-like manner. The merchandiser assembly greatly facilitates stock rotation, is self-facing, and automatically maintains an organized and properly positioned stock of products. A product tray is slidably mounted with respect to a support member, and a product follower that is slidably mounted with respect to the product is limited in the extent of its forward movement in order to provide free space for the refilling of the merchandiser assembly with fresh products which the merchandiser assembly is in a fill mode.

33 Claims, 3 Drawing Sheets

MERCHANDISER ASSEMBLY

This application is a continuation of copending application Ser. No. 455,838, filed Dec. 15, 1989, U.S. Pat. No. 5,012,936, May 7, 1991 which is a continuation of Ser. No. 176,954, filed Apr. 4, 1988, now U.S. Pat. No. 4,907,707, Mar. 13, 1990.

BACKGROUND AND DESCRIPTION OF THE INVENTION

The present invention generally relates to an assembly for storing and displaying products while they are being merchandised in a retail outlet or the like. More particularly, the merchandiser assembly according to the present invention is structured to store merchandise products on shelves from which purchasers can select and remove one or more of the products from the merchandiser assembly. The merchandiser assembly maintains the products in a generally horizontally stacked orientation in a manner by which the front of the stack of products is automatically maintained in the front of the merchandiser assembly even after a product that had been in the front of the merchandiser assembly has been removed.

In the retail sales industry, there is often a need to display a supply of products for selection and purchase by consumers. Various display cases, racks, hangers, open shelves and the like have been used for this purpose. Sometimes these storage and display devices are at room temperature, and in other instances they are under refrigeration, either in open cases or compartments or behind temperature barriers such as glass doors.

Certain problems are generally common to these types of merchandising display facilities. Because it is desired to avoid selling products that have been warehoused, stored and displayed for extended periods of time, it is desirable to ensure that the products that are in stock are rotated in a manner whereby the oldest product stock is toward the front of the shelf or the like, which requires in most circumstances that the fresher or newer stock must be placed behind the older stock. In most instances, achieving this desirable stock rotation requires removal of the older products on the front of the shelf or pegboard or the like or on top of the stack of products or the like in order that the newer stock can be placed behind or under these older stocks. This is, of course, a very time-consuming operation and is often very labor intensive and thus can be quite expensive. There can be a tendency for this desirable practice of stock rotation to be substantially ignored or practiced only to a limited extent.

Another problem with many product merchandisers is the need to "face" them after consumers have removed the front products from the display unit. This problem is particularly evident for items that are stored and displayed on generally horizontal shelves. Often these shelves can be quite deep, and if the products are not manually moved toward the front, or face, of the shelf, the products will not be properly displayed to the customers in order to achieve desired merchandising and marketing effects, such as the prominent display of a famous or well-promoted label and/or brand name or the like.

Another matter associated with product merchandiser devices that requires some attention is the desirability to maintain the merchandiser unit in an organized fashion so that it presents an orderly and attractive appearance. Merchandiser devices such as pegbar units which suspend packaged products at a generally fixed location tend to positively respond to this objective in that pegbar units tend to present a more organized appearance than when products are stored on an open shelf or in stacks. In the latter instances, products can become misaligned from their desired location on the shelf or stack and thereby become improperly placed with respect to product and price identifiers or other point of purchase materials. Another aspect of desirable shelf organization is to have the individual products aligned in neat rows or the like, which can require some labor-intensive attention at various times.

It has been found that, by proceeding in accordance with the present invention, it is possible to provide a product merchandiser that greatly facilitates stock rotation, that is self-facing, and that automatically maintains an organized and properly positioned stock of products. In addition, the present invention can be utilized in order to hold relatively flat packages in a generally upright or on-edge orientation in order to create a display that is visibly pleasing and also that prominently displays packaging designs, graphics, product vignettes, brand names and the like. The invention is particularly useful for displaying and merchandising packaged food products.

In summary, the present invention is a merchandiser assembly of the type that will store stocks of products and will display those products to consumers or the like. The merchandiser assembly has a basic shelf structure. Included is a track assembly that is generally horizontally positioned. A product tray member holds and supports a stock of products that are generally horizontally stacked alongside one another. The product tray member is slidably engaged with the track assembly so that the product tray member can be slid away from the track assembly. An upstanding product follower is slidably mounted onto the product tray member in a manner whereby the follower moves longitudinally within the product tray member. The product follower member is biased in a forward direction, and it follows the horizontal stack of products toward the front of the merchandiser assembly when a product is removed from the front of the product tray member. In addition, when the product tray member is slidably extended forwardly, a fill mode is provided whereby the upstanding product follower member does not move beyond the front of the track member in order to thereby form a stocking space between the upstanding follower member and whatever products might be in the front portion of the product tray member.

It is a general object of the present invention to provide an improved assembly for merchandising products, especially consumer products.

Another object of the present invention is to provide an improved product merchandiser assembly that facilitates stock rotation, that is self-facing, and that improves shelf organization.

Another object of this invention is to provide an improved product merchandiser assembly that reduces the time needed to maintain merchandising shelves that exhibit extremely desirable marketing attributes.

Another object of the present invention is to provide an improved product merchandiser assembly that holds packaged products in an upright position in order to create visually superior and pleasing displays of the packaged products.

Another object of the present invention is to provide an improved product merchandiser assembly that effects automatic facing of products stored therein and merchandised thereby.

Another object of the present invention is to provide an improved merchandiser assembly that is especially useful for marketing and selling packaged cold meat products and the like that are organized in a generally shelf-like orientation.

Another object of this invention is to provide an improved merchandiser assembly that is durable and re-usable.

These and other objects, features and advantages of this invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
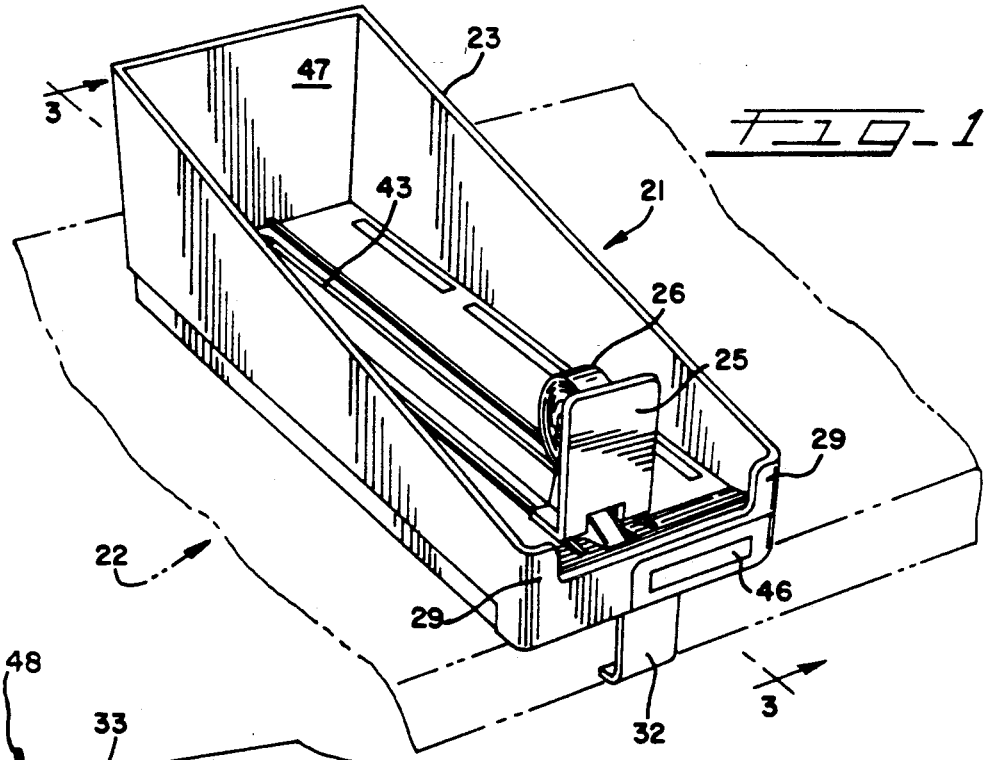
FIG. 1 is a perspective view of a preferred embodiment of the merchandiser device according to this invention, shown in a completely empty state.

A merchandiser assembly device is generally designated as 21 in FIGS. 1 through 6. Merchandiser assembly 21 is illustrated resting on and mounted onto a shelf assembly shown in phantom at 22. It will be appreciated that merchandiser assembly 21 can be mounted on any of a variety of shelving arrangements, and a plurality of such merchandiser devices 21 can be provided, typically in side-by-side relationship with each other. It is also possible that the merchandiser device could include its own shelving assembly, for example as an integral component of the merchandiser assembly itself. For ease of discussion and illustration, the drawings show the merchandiser assembly 21 in an embodiment by which same is added to an existing shelf assembly 22.

Merchandiser assembly 21 includes a product tray member 23 that is slidably mounted onto a track member or assembly 24. A generally upstanding product follower 25 is slidably mounted in a generally longitudinal manner within the product tray member 23. The upstanding product follower 25 is biased in a forward orientation (defined as being toward the right as viewed in FIGS. 3, 4 and 5) by a biasing member 26.

Figures 3, 4:
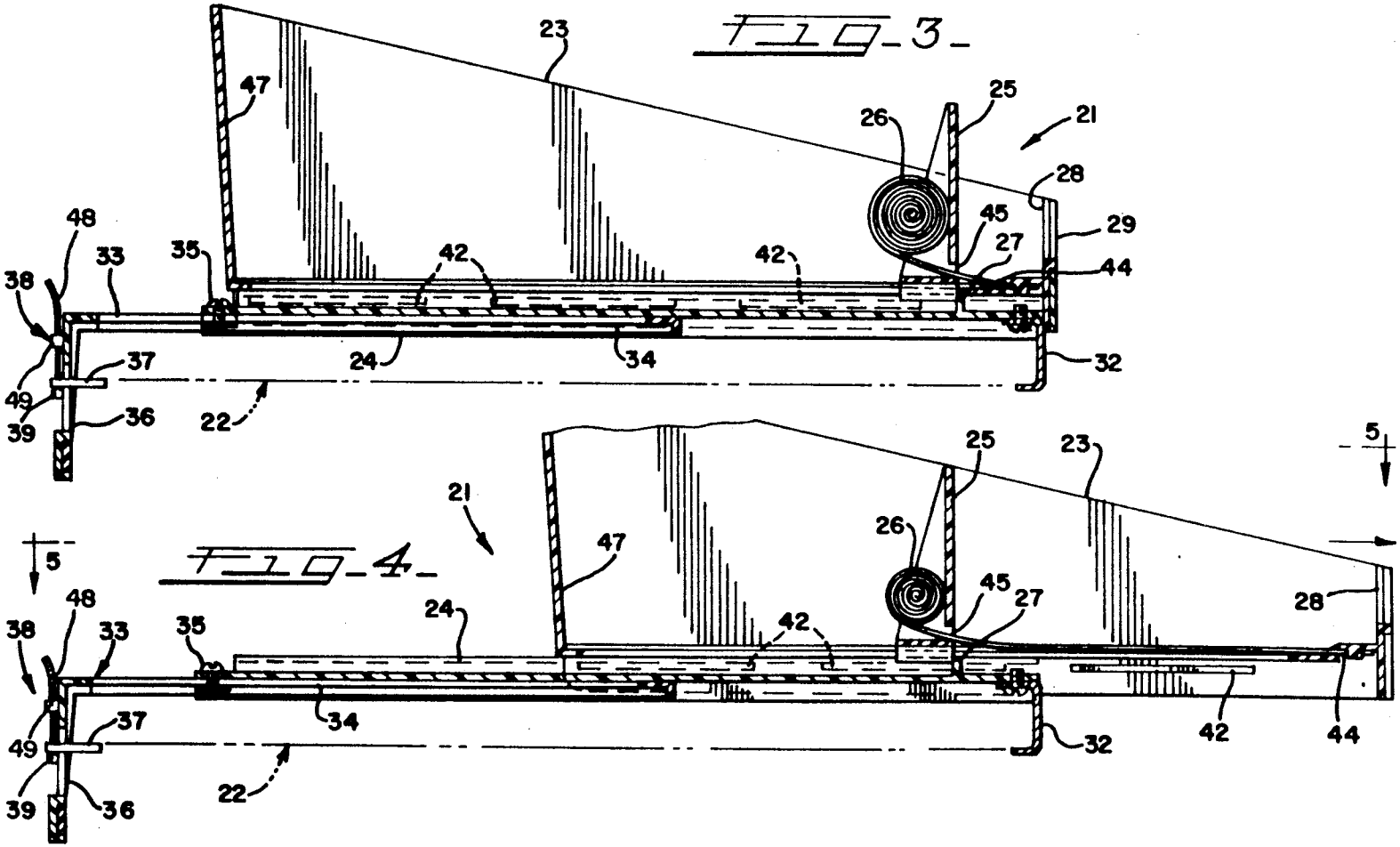
FIG. 3 is a cross-sectional view along the line 3—3 of FIG. 1.
FIG. 4 is a cross-sectional view similar to FIG. 3, but showing the product tray in an orientation between the empty state of FIGS. 1 and 3 and the fill mode of FIG. 2.

The empty and non-loading mode of the merchandiser assembly 21 is best seen in FIG. 1 and in FIG. 3. The product follower 25 is in its forwardmost position, while the product tray member 23 is in its rearwardmost position (with the rear of the merchandiser assembly 21 being defined as toward the left as viewed in FIG. 3). This mode is automatically presented when the merchandiser assembly 21 has been completely emptied or when only about one of the products being merchandised remains within the merchandiser assembly 21. When this mode is observed, the stocking employee will know that the display stock of this particular item has been exhausted and that refilling is now necessary.

Figure 2:
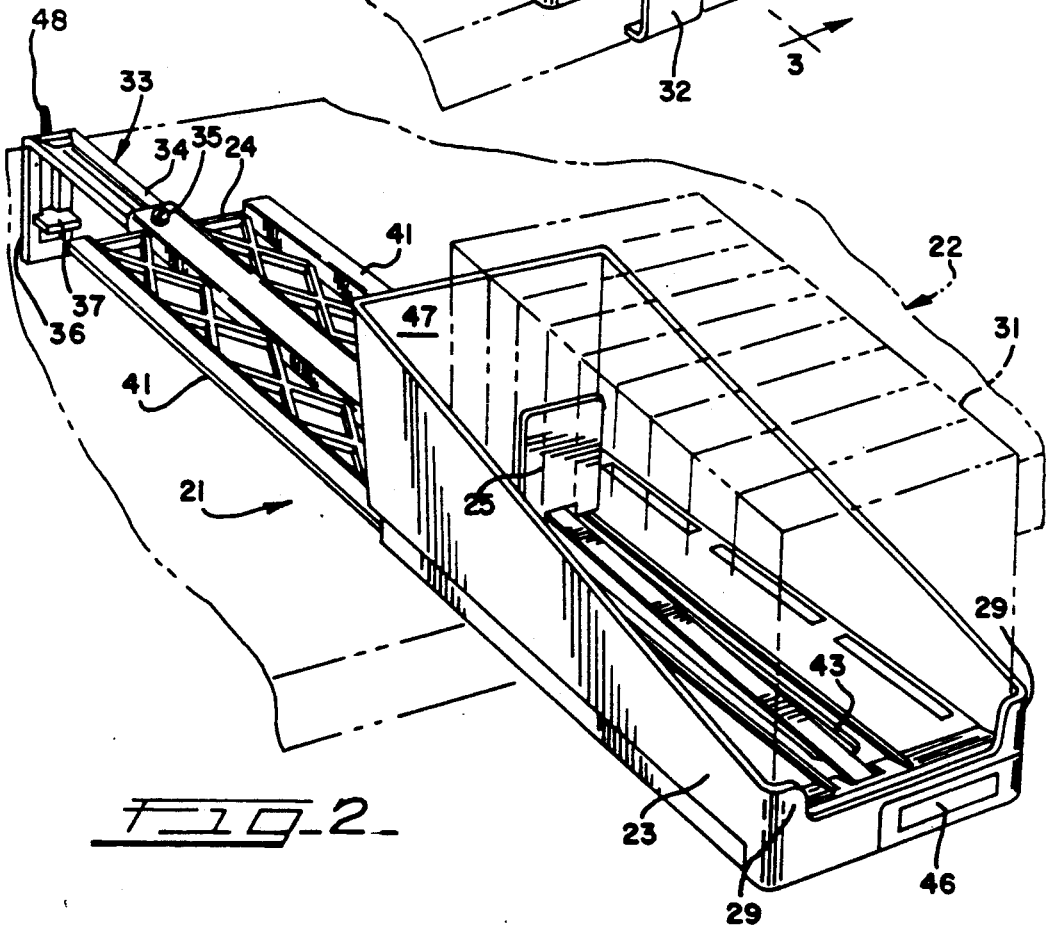
FIG. 2 is a perspective view of the assembly shown in FIG. 1, illustrating the fill mode of the assembly.
Figure 5:
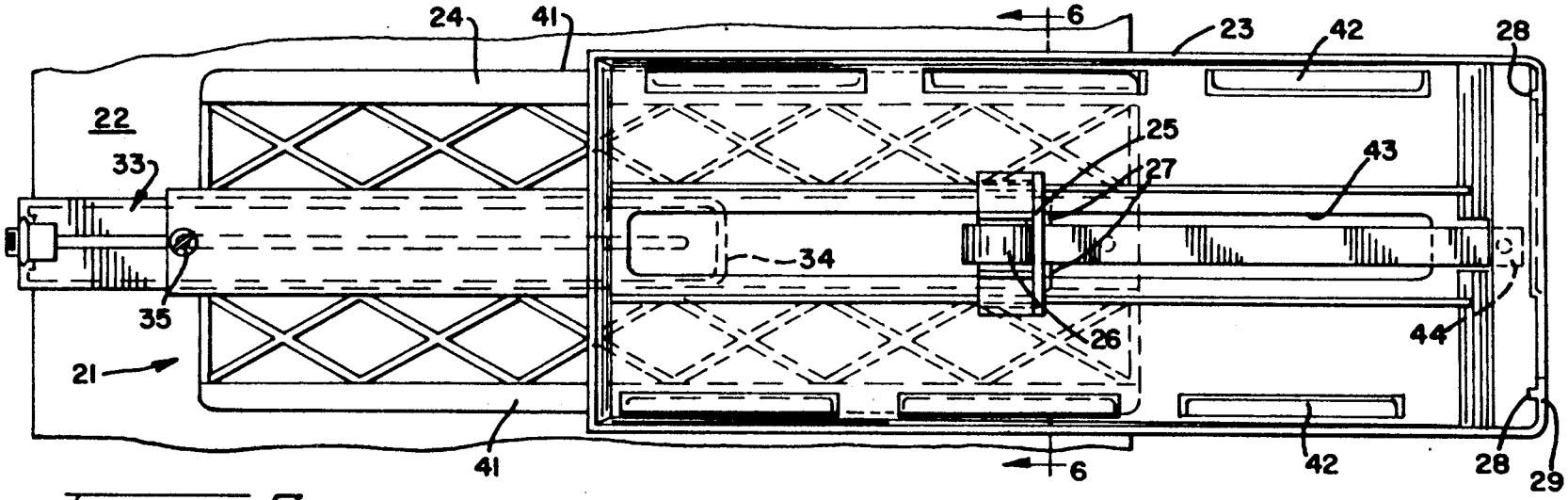
FIG. 5 is a top plan view generally along the line 5—5 of FIG. 4.
Figure 6:
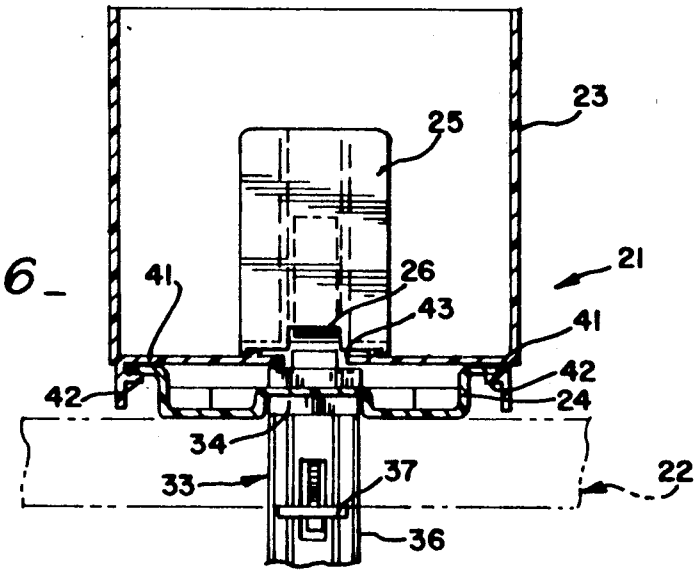
FIG. 6 is a cross-sectional view along the line 6—6 of FIG. 5.

The filling mode is perhaps best appreciated by a consideration of FIGS. 2, 4 and 5. In FIG. 2, the product tray member 23 is shown in its substantially fully extended orientation after it has been pulled by the stocking employee in a forward direction as defined herein. It will be noted that, when such movement or extension in the forward direction is effected, the generally upstanding product follower 25 does not necessarily likewise move forwardly to the same extent. Instead, the product follower 25 engages a typically fixed component which limits the forward movement of the upstanding product follower 25. The movement limiter which is illustrated in the drawings in this regard includes one or more stops 27 positioned at the front end portion of the track assembly 24. By this arrangement, the product follower 25 is automatically spaced away from the inside surface 28 of each of one or more upstanding front members 29 of the product tray member 23. Accordingly, when the product tray member 23 is in a forwardly extended orientation, free space is provided between the front face of the product follower 25 and the inside surface 28 or the back surface of any product remaining within the product tray 23 of the merchandiser assembly 21. Then, the stocking employee can insert a desired number of products 31 in a generally horizontally stacked orientation, which is shown in phantom in FIG. 2.

Once the product tray 23 is filled with products 31 to the extent desired, the product tray 23 is returned to its unextended or rearwardmost position. A position generally midway between the fully extended mode shown in FIG. 2 and the fully retracted mode shown in FIGS. 1 and 3 is illustrated in FIG. 4 and in FIG. 5. It will be noted that the upstanding product follower 25 is still in engagement with the stop 27 or the like, but the distance between the inside surface of the product follower 25 and the inside surface 28 is less than that shown in FIG. 2. It will be appreciated that, if the product tray member 23 were filled with products 31, such products 31 would move the product follower member 25 in a rearward direction and in opposition to the biasing member 26. In other words, if the space between the upstanding product follower 25 and the inside surface 28 that is depicted in FIG. 4 were filled with product, then further movement of the product tray member 23 in a retracting or rearward direction (to the left in FIG. 4) would result in movement of the product follower 25 in that retracting or rearward direction due to its engagement by the stack of products moving in that direction.

When the merchandiser assembly 21 is provided in the form illustrated wherein same is designed to be supported by and secured onto a shelf 22 of a separate shelf assembly, it is preferred to provide adjustable means by which the merchandiser assembly 21 can be thus secured. Illustrative of such an arrangement is the track assembly 24 that is depicted in the drawings. Track assembly 24 includes a front clamp or clip 32 that generally wraps around front edge of the shelf 22. While not illustrated, this front clamp or clip structure 32 can be adjustable so as to accommodate different shelf thicknesses. It is typically more important to provide an adjustment assembly with respect to the rear securement assembly of the track assembly 24. Illustrated rear securement assembly in this regard includes a generally L-shaped bracket assembly 33.

Bracket assembly 33 includes a generally horizontal arm 34 that is slidably mounted to the track assembly 24 so that the L-shaped bracket assembly 33 is extendable from and retractable toward the track assembly 24. Positioning of the generally horizontal arm 34 of the L-shaped bracket assembly 33 can be secured by any suitable means such as the illustrated retainer screw 35. The illustrated L-shaped bracket assembly 33 further includes a generally downwardly depending arm 36 that also includes an adjustability feature. More specifically, a clamping plate 37 is slidably secured to the downwardly depending arm 36 in a manner by which the clamping plate 37 is forwardly extending so as to form a generally U-shaped clamping assembly with the L-shaped bracket assembly 33. A securement assembly 38 is provided in order to maintain the desired position of the clamping plate 37. The illustrated securement assembly 38 includes a so-called cable tie or the like having a head 39 secured to a tail 48 thereof. The tail 41 is passed through a suitable opening within the clamping plate 37 and then through a ratcheting block 49 which prevents return movement of the tail 48.

Accordingly, a typical operation by which the illustrated merchandiser assembly 21 is secured onto the shelf 22 proceeds as follows. The clamping plate 37 is positioned toward the free end of the downwardly depending arm 36 of the L-shaped bracket assembly 33. The merchandiser assembly 21 is positioned on the shelf 22 until the front clamp or clip 32 engages the front edge of the shelf 22. Then, the generally horizontal arm 34 of the L-shaped bracket assembly 33 is moved as necessary until the inside surface of the downwardly depending arm 36 engages the rear edge of the shelf 22, after which the retainer screw 35 or the like is used to maintain this position of the generally horizontally extending arm 34. After this, the person installing the merchandiser assembly 21 pulls the tail 48 of the cable tie until the inside or top surface of the clamping plate 37 engages the bottom, rear edge of the shelf 22. The thus installed merchandiser assembly 21 will remain in place until, for example, the cable tie is removed or released.

With more particular reference to the illustrated preferred structure of the merchandiser assembly 21, the illustrated slidable engagement between the product tray member 23 and the track assembly 24 is carried out by positioning longitudinal edges 41 of the track assembly 24 within longitudinally oriented shelf protrusions 42 that are positioned along the underside of the product tray member 23. Also in accordance with the preferred embodiment, the upstanding product follower 25 is slidably mounted within a longitudinal slot 43 in the bottom panel of the product tray 23. The illustrated biasing member 26 for the upstanding product follower 25 is a roll spring having a forward end 44 thereof secured at the front end of the product tray 23. The roll spring passes through an orifice 45 of the upstanding product follower 25 so that the biasing member 26 will provide forwardly directed biasing forces on the upstanding product follower 25. When desired, a graphics insert 46 can be provided to facilitate identification of the products 31 to be displayed and dispensed by the merchandiser assembly 21.

It is to be observed that, with the preferred structure that is shown in the drawings, excessive forward movement of the product tray 23 is substantially prevented by interaction of the upstanding product follower 25, the stop 27 on the track assembly 24, and the slot 43 or the back wall 47 of the product tray 23. More specifically, when the product tray 23 is fully extended as shown in FIG. 2, further forward movement of the product follower 25 is prevented by its engagement with the stop 27. Furthermore, the thus stopped product follower 25 will engage either the back wall 47 or the back end of the slot 43 of the product tray 23, which in turn prevents further forward movement of the product tray 23. If desired, supplemental stops could be provided to further strengthen this stopping function. Also, suitable release means could be added in order to permit removal of the product tray 23, if this should be found to be desirable.

It will be appreciated that the merchandiser assembly 21 greatly facilitates stock rotation. When the merchandiser assembly 21 is in its extended orientation as illustrated in FIG. 2, the stocking employee can readily insert the fresher product behind whatever products 31 may be remaining in the merchandiser assembly 21 at the time of the stocking activity. There is no need to move any of the remaining products 31 inasmuch they will already be in the front of the product tray member 23 while the free space that is provided when the device is in the FIG. 2 orientation is between these remaining products 31 and the product follower 25. It will be further appreciated the the merchandiser assembly is self-facing. When the merchandiser assembly 21 is in the fully retracted and in-use mode as shown in FIGS. 1 and 3, any products 31 within the product tray member 23 will be pushed forwardly by the action of the biasing member 26 on the upstanding product follower 25 when one or more of the products 31 are removed from the front of the product tray member 23. It will be further observed that the combination of the features of the merchandiser assembly 21 automatically maintains an organized and properly positioned stock of products 31 which are readily recognized and removed by the consumer without resulting in disorganization or improper positioning of products.

Preferably, the components of the merchandiser assembly 21 will be made of durable and attractive materials. While metal materials typically would be suitable, moldable polymers are preferred for most of the components, except for ones such as the biasing member, because of the ease of formation and relatively low cost provided by such moldable polymers.

It will be understood that the embodiments of the present invention which have been described are illustrative of some of the applications of the principles of the present invention. Numerous modifications may be made by those skilled in the art without departing from the true spirit and scope of the invention.

I claim:

1. A merchandiser assembly for use in storing and displaying products in a shelf-like orientation, the merchandiser assembly comprising:

product tray means for holding and supporting a plurality of merchandised products, said product tray means having a front end portion and a rear end portion, said product tray means being open from above for displaying and accessing said products;

track means for providing generally horizontally oriented support of said product tray means, said track means having a front portion;

engagement means of said product tray means and of said track means for effecting sliding engagement between said product tray means and said track means and for permitting said product tray means to move with respect to said track means along a pathway that is generally longitudinally oriented with respect to said product tray means;

a generally upstanding product follower member slidably mounted with respect to said product tray means for movement generally between said rear end portion and said front end portion of the product tray means;

biasing means for urging said product follower member and any merchandised products in front of said product follower member generally toward said front end portion of the product tray means, said biasing means including a roll spring behind said product follower and having one end secured to said product tray means; and stop means for engaging said product follower member with said front portion of the track means when the merchandiser assembly is in a fill mode at which the front end portion of said product tray means is slidably extended beyond said front portion of the track means, whereby movement of said generally upstanding product follower member beyond said front portion of the track means is prevented and whereby said product follower member is positioned in spaced away relationship with respect to said front end portion of the product tray means in opposition to said biasing means.

2. The merchandiser assembly according to claim 1, wherein said product tray means is for holding a plurality of merchandised products oriented in a generally horizontally oriented stack.

3. The merchandiser assembly according to claim 1, wherein said stop means includes a stop member positioned along said front portion of the track means, and wherein said stop member engages a lower portion of said generally upstanding product follower member.

4. The merchandiser assembly according to claim 1, whereby said fill mode provides free space between said product follower member and the back face of the rearwardmost positioned merchandised product within the product tray means.

5. The merchandiser assembly according to claim 1, wherein said track means includes clamp means for securing the merchandiser assembly to a shelf, said clamp means including a front clamp and an adjustable rear securement assembly.

6. The merchandiser assembly according to claim 1, wherein said track means includes clamp means for securing the merchandiser assembly to a shelf, said clamp means including an adjustable securement assembly having generally U-shaped means for engaging a rear edge and a bottom edge of the shelf.

7. The merchandiser assembly according to claim 6, wherein said adjustable securement assembly includes a ratcheting tie means for one-way adjustment of a shelf-engaging member of the generally U-shaped means.

8. The merchandiser assembly according to claim 1, wherein a longitudinal slot is included within the product tray means, and wherein said product follower member is slidably mounted along said slot.

9. The merchandiser assembly according to claim 1, wherein said upstanding product follower member engages a portion of said product tray means, whereby forward movement of said product tray means which separates same from said track means is prevented.

10. A merchandiser assembly, comprising:

product tray means for holding and supporting a generally horizontally oriented stack of merchandised products that are in an on-edge orientation, said product tray means having a front portion and a rear portion, said product tray means being open from above for displaying and accessing said products;

track means for generally horizontally supporting said product tray means, said track means having a front portion;

said product tray means is slidably secured to said track means in an orientation that is generally longitudinal of said product tray means, whereby said product tray means is movable between a rearwardmost, in-use mode and a forwardly extended, fill mode;

a product follower member slidably secured onto said product tray means, said product follower member being slidable between said front portion and said rear portion of the product tray means, the product follower member being adapted to be positioned in back of the stack of merchandised products;

biasing means for urging said product follower member toward said front portion of the product tray means, said biasing means including a roll spring behind said product follower and above said track means, and having one end secured to said product tray means; and stop means for preventing movement of the rear portion of said product tray means beyond said front portion of the track means, said stop means further preventing forward movement of said product follower member beyond said front portion of the track means.

11. The merchandiser assembly according to claim 10, wherein free space is defined between said product follower member and said front portion of the product tray means when the merchandiser assembly is in its said forwardly extended, fill mode.

12. The merchandiser assembly according to claim 10, wherein said track means includes clamp means for securing the merchandiser assembly to a shelf, said clamp means including an adjustable securement assembly having generally U-shaped means for engaging a rear edge and a bottom edge of the shelf.

13. The merchandiser assembly according to claim 12, wherein said adjustable securement assembly includes means for one-way adjustment of a shelf-engaging member of the generally U-shaped means.

14. The merchandiser assembly according to claim 10, wherein a longitudinal slot is included within the product tray means, and wherein said product follower member is slidably mounted along said slot.

15. Method for storing and displaying products in a shelf-like orientation, the method comprising the steps of:

(a) positioning a track assembly on a generally horizontal shelf having a front edge and a rear edge;

(b) extending a tray member slidably engaging the track assembly, said extending step being in a generally forward direction and generally horizontally parallel to the shelf;

(c) forming a stocking space between a generally vertically-oriented upstanding follower member and an inside front surface of the tray member, said forming step including engaging the follower member with a stop such that as the tray member is slid forwardly the follower member is prevented from moving forwardly;

(d) inserting products having generally planar side walls, a generally planar face, and a generally planar back wall into the stocking space, said inserting step including aligning the products such that one of the side walls of each of said products is generally adjacent to a floor of said tray member, the planar face of each of said products is directed forwardly, and the planar face of the forwardmost of the inserted products is generally adjacent to the inside front surface of the tray member;

(e) returning the tray member to an unextended rearward display position, said returning step including sliding the tray member rearwardly and generally horizontally parallel to said shelf such that the planar back wall of the rearwardmost of the inserted products contacts a forward face of the product follower; and (f) biasing the products forwardly when a displayed product is removed from the tray member, said biasing step including moving the product follower forwardly thereby automatically filling a void formed by the removal of the displayed product.

16. The method according to claim 15, further including securing the tray assembly to the shelf.

17. The method according to claim 16, wherein said securing step includes clamping a rear portion of the track assembly to the rear edge of the shelf.

18. The method according to claim 17, wherein said clamping includes attaching a clamping assembly of the track assembly to the rear edge of the shelf.

19. The method according to claim 16, wherein said securing step includes clamping a front portion of the track assembly to the front edge of the shelf.

20. The method according to claim 19, wherein said clamping step includes attaching a clamping plate of the track assembly to the front edge of the shelf.

21. The method according to claim 15, further including securing a front portion of the track assembly to the front edge of the shelf and attaching a rear portion of the track assembly to the rear edge of the shelf.

22. The method according to claim 21, wherein said securing includes attaching a clamping plate of the track assembly to the front edge of the shelf and attaching a clamping assembly of the track assembly to the rear edge of the shelf.

23. The method according to claim 15, further including rotating additional products into the previously displayed products already in the tray member, said rotating step including, pulling the tray member forwardly such that the forwardmost one of the previously displayed products remains proximate to the inside front surface of the tray member and a restocking space opens between the planar back wall of the rearwardmost product and the forward face of the product follower;

inserting additional products rearwardly of the rearwardmost previously displayed product such that planar faces of the respective products are directed forwardly and one of the side walls is adjacent to the floor of the tray member; and returning the tray member to the unextended display position, whereby access by consumers to previously displayed products is more immediate than to the additional products thereby encouraging the sale of previously displayed products before the additional products.

24. Method for facilitating organized sale and rotation of packaged products, said method comprising the steps of:

(a) positioning a track assembly on a generally horizontal shelf such that at least a forward portion of the assembly is generally proximate to a front edge of the shelf;

(b) extending forward to a fill position a tray member slidably carried on and above the track assembly such that a front member of said tray member is forward of the forward portion of the track assembly;

(c) aligning packaged products having generally planar side walls, planar faces, and planar backs on the tray member, said aligning step including forming a line of the packaged products by placing one of said packaged products in front of another of the packaged products and on one of the side walls of the products with the planar faces of said packaged products forwardly directed;

(d) returning the tray member to a display position, said returning step including engaging the planar back of a rearwardmost aligned product with a front face of a product follower and pushing the product follower in a rearward direction by the line of packaged products in opposition to a biasing member;

(e) moving the line of packaged products forwardly as one or more of the packaged products in the line are removed while in the display position;

(f) restocking the tray member, said restocking step including forming a free space between the planar back of the rearwardmost aligned packaged product and the forward face of the product follower, said forming step including blocking the product follower from engagement with the planar back of the rearwardmost aligned packaged product;

(g) said restocking step including inserting new products in the free space such that the planar faces of the packaged products are forwardly directed and the one of the side walls is adjacent to the floor; and (h) whereby said returning of the tray member to said display position facilitates immediate sales access to the packaged products inserted previously to the new products, whereby the packaged products are rotated.

25. The method according to claim 24, further including securing the forward portion of the tray assembly to the front edge of the shelf and a rearward portion of the tray assembly to a rear edge of the shelf, whereby the tray assembly is prevented from being accidentally dislodged from the shelf.

26. The method according to claim 24, further including biasing the tray member to the display position, said biasing step including attaching a forward end of a roll spring to the front member of the tray member whereby the tray member is automatically pulled rearwardly to the display position.

27. The method according to claim 24, wherein said blocking step includes contacting the product follower with a back end of a slot within the track assembly.

28. The method according to claim 24, wherein said extending step includes preventing the tray member from being over-extended, said preventing step including contacting a back of the tray member with a roll spring.

29. A merchandiser assembly for use in organizing products for sale, the merchandiser assembly comprising:

a track assembly including a front portion and a rear portion;

a tray member for supporting a plurality of products, said tray member including a front member and a rear member;

engagement means for effecting sliding engagement between said track assembly and said tray member, whereby said tray member can be slid from a rearwardmost display position to a forward filling position;

a product follower mounted within a longitudinal slot such that said product follower can slide;

a means for biasing said product follower forwardly, said biasing means extending from behind said product follower and having one end secured to said product tray means to said front member;

a movement limiter for blocking forward movement of said product follower, whereby when said tray member is extended to said forward filling position free space opens between a front face of said product follower as blocked and an inside surface of said front member in which products can be inserted; and means for securing said track assembly to a shelf on which said track assembly rests.

30. The merchandiser assembly according to claim 29, wherein said product follower is generally vertically oriented.

31. The merchandiser assembly according to claim 30, wherein said biasing means includes a roll spring having a forward end secured to said front member.

32. The merchandiser assembly according to claim 29, wherein said engagement means includes longitudinal edges positioned generally below a lower surface of said tray member.

33. The merchandiser assembly according to claim 32, wherein said engagement means includes longitudinally oriented shelf protrusions positioned below said lower surface and including openings along which said longitudinal edges can slide.

* * * * *